US008648244B2

(12) United States Patent
Dahl

(10) Patent No.: US 8,648,244 B2
(45) Date of Patent: Feb. 11, 2014

(54) PERCUSSION INSTRUMENT AND METHOD OF MANUFACTURE

(71) Applicant: J. Greg Dahl, Grants Pass, OR (US)

(72) Inventor: J. Greg Dahl, Grants Pass, OR (US)

( * ) Notice: Subject to any disclaimer, the term of this patent is extended or adjusted under 35 U.S.C. 154(b) by 0 days.

(21) Appl. No.: 13/738,478

(22) Filed: Jan. 10, 2013

(65) Prior Publication Data

US 2013/0192449 A1 Aug. 1, 2013

Related U.S. Application Data

(60) Provisional application No. 61/585,268, filed on Jan. 11, 2012.

(51) Int. Cl.
*G10H 3/14* (2006.01)
*G10D 13/08* (2006.01)

(52) U.S. Cl.
USPC ..... 84/730; 84/402

(58) Field of Classification Search
USPC ..... 84/402, 410, 730
See application file for complete search history.

(56) References Cited

U.S. PATENT DOCUMENTS

| | | | | |
|---|---|---|---|---|
| 4,165,671 | A * | 8/1979 | De Bose | 84/402 |
| 5,212,331 | A | 5/1993 | Waldo | |
| D372,054 | S | 7/1996 | Meyer | |
| 5,602,354 | A | 2/1997 | Martin | |
| D380,239 | S | 6/1997 | Zur | |
| 5,659,143 | A | 8/1997 | Isackson | |
| D388,322 | S | 12/1997 | Hoeting et al. | |
| 5,955,125 | A * | 9/1999 | Hoeting et al. | 426/104 |
| 6,093,428 | A * | 7/2000 | Hoeting et al. | 426/104 |
| D437,362 | S * | 2/2001 | Campbell | D21/406 |
| 6,255,572 | B1 * | 7/2001 | Moghaddam et al. | 84/402 |
| 6,365,810 | B1 * | 4/2002 | Enhoffer et al. | 84/402 |
| 6,392,129 | B1 * | 5/2002 | Enhoffer et al. | 84/402 |
| 6,555,736 | B1 * | 4/2003 | Delosreyes | 84/402 |
| 6,620,991 | B1 * | 9/2003 | Honiball | 84/402 |
| 7,045,695 | B1 * | 5/2006 | Cohen | 84/402 |
| D601,617 | S | 10/2009 | Cohen | |

* cited by examiner

*Primary Examiner* — Jeffrey Donels
(74) *Attorney, Agent, or Firm* — Greenblum & Bernstein, P.L.L.C.

(57) ABSTRACT

A percussion instrument including an acoustic chamber housing having a zigzag shape, a material chamber housing having the zigzag shape, a sound board having the zigzag shape arranged between the acoustic chamber housing and the material chamber housing to form an acoustic chamber defined by the acoustic chamber housing and the sound board, and a material chamber defined by the material chamber housing and the sound board, and particulate material arranged in the material chamber.

20 Claims, 6 Drawing Sheets

PERCUSSION INSTRUMENT AND METHOD OF MANUFACTURE

CROSS REFERENCE TO RELATED APPLICATION

The present application claims priority to U.S. Provisional Application No. 61/585,268 filed on Jan. 11, 2012, the disclosure of which is expressly incorporated by reference herein in its entirety.

BACKGROUND OF THE INVENTION

1. Field of the Invention

The present invention relates generally to a percussion instrument, and in particular, a multi-percussive hand drum.

2. Description of the Related Art

In small venues, a drummer may not be able to play due to the lack of space for a full-sized drum set. The lack of percussion can create a void in the musical experience of the performance as well as for the audience. The fullest percussive potential has not yet been achieved by artists, as there are many sounds and textures that are not yet available for convenient musical use. Accordingly, an effective and versatile solution is desired.

SUMMARY OF THE INVENTION

The present invention is a percussion instrument, and more particularly, multi-percussive hand drum designed to create varied and rhythmic sounds for musical accompaniment or as a stand-alone instrument. The present invention allows percussionists to experiment with innovative percussive methods, including rain stick, shaker, and hand drum methods. In embodiments, the present invention includes a pickup device (e.g., a piezo pickup) to provide amplifying abilities for the sounds generated with the percussion instrument.

By implementing the present invention, the percussion instrument can take the place of a large drum set, for example, in small venues, or be used as its own percussive section in large venues. Additionally, in embodiments, when plugged into a multi-effects floor pedal via the integrated pickup and jack, the possibilities for sonic variation are endless.

Aspects of embodiments of the present invention are directed to a percussion instrument, comprising an acoustic chamber housing having a zigzag shape, a sand chamber housing having the zigzag shape, a sound board having the zigzag shape arranged between the acoustic chamber housing and the sand chamber housing to form an acoustic chamber defined by the acoustic chamber housing and the sound board, and a sand chamber defined by the sand chamber housing and the sound board, and particulate material arranged in the sand chamber.

In embodiments, the percussion instrument further comprises a pickup device arranged on the sound board.

In further embodiments, the pickup device comprises a piezo transducer.

In additional embodiments, the percussion instrument further comprises an instrument jack connected to the pickup device and arranged at an exterior surface of the percussion instrument.

In yet further embodiments, the particulate material comprises one or more types of sand.

In embodiments, the sound board is structured and arranged substantially parallel to a longitudinal axis of the percussion instrument.

In further embodiments, the acoustic chamber housing comprises at least one sound hole.

In additional embodiments, the sound board is structured and arranged to resonate.

In yet further embodiments, the acoustic chamber, the sand chamber housing, and the sound board are laminated together to form the acoustic chamber and the sand chamber.

In embodiments, the percussion instrument further comprises a removable cap, wherein the sand chamber housing comprises a hole structured and arranged for removing and/or placing the particulate material into the sand chamber, and wherein the at least the plug is structured and arranged to seal the hole.

In further embodiments, the sound board is structured and arranged substantially non-parallel or slanted with respect to a longitudinal axis of the percussion instrument so as to form a tapered acoustic chamber and a tapered sand chamber.

In additional embodiments, the zigzag shape comprises a longitudinal axis line of respective adjacent sections of the percussion instrument extending at an angle first in a first direction, then sharply orthogonal to the first direction, and then back to the first direction.

In yet further embodiments, the acoustic chamber housing, the sand chamber housing, and the sound board comprise one or more types of wood.

In embodiments, at least one of the acoustic chamber housing, the sand chamber housing, and the sound board comprise one or more types of plastic.

In further embodiments, the acoustic chamber is isolated from the sand chamber by the sound board arranged there between.

Aspects of further embodiments of the present invention are directed to a method of making a percussion instrument comprising an acoustic chamber housing having a zigzag shape; a sand chamber housing having the zigzag shape; a sound board having the zigzag shape arranged between the acoustic chamber housing and the sand chamber housing. The method comprises bonding the acoustic chamber housing, the sound board, and the sand chamber housing together to form an acoustic chamber defined by the acoustic chamber housing and the sound board, and a sand chamber defined by the sand chamber housing and the sound board, and providing a particulate material in the sand chamber.

In embodiments, the method further comprises forming each of the acoustic chamber housing, the sound board, and the sand chamber housing to have respective corresponding zigzag shapes.

In further embodiments, the method further comprises forming an acoustic chamber space in the acoustic chamber housing by removing material from the acoustic chamber housing, and forming a sand chamber space in the sand chamber housing by removing material from the sand chamber housing.

In additional embodiments, the method further comprises molding the acoustic chamber housing to form an acoustic chamber space, and molding the sand chamber housing to form a sand chamber space.

Aspects of further embodiments of the present invention are directed to a percussion instrument, comprising an acoustic chamber housing having a zigzag shape, and a sound board having the zigzag shape arranged on the acoustic chamber housing to form an acoustic chamber defined by the acoustic chamber housing and the sound board.

Aspects of further embodiments of the present invention are directed a percussion instrument, comprising a material chamber housing having a zigzag shape, a sound board having the zigzag shape arranged on the material chamber housing to form a material chamber defined by the material chamber housing and the sound board, and particulate material arranged in the material chamber.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

BRIEF DESCRIPTION OF THE FIGURES

For a more complete understanding of the invention, as well as other objects and further features thereof, reference may be had to the following detailed description of the invention in conjunction with the following exemplary and non-limiting drawings wherein.

Figure 1:
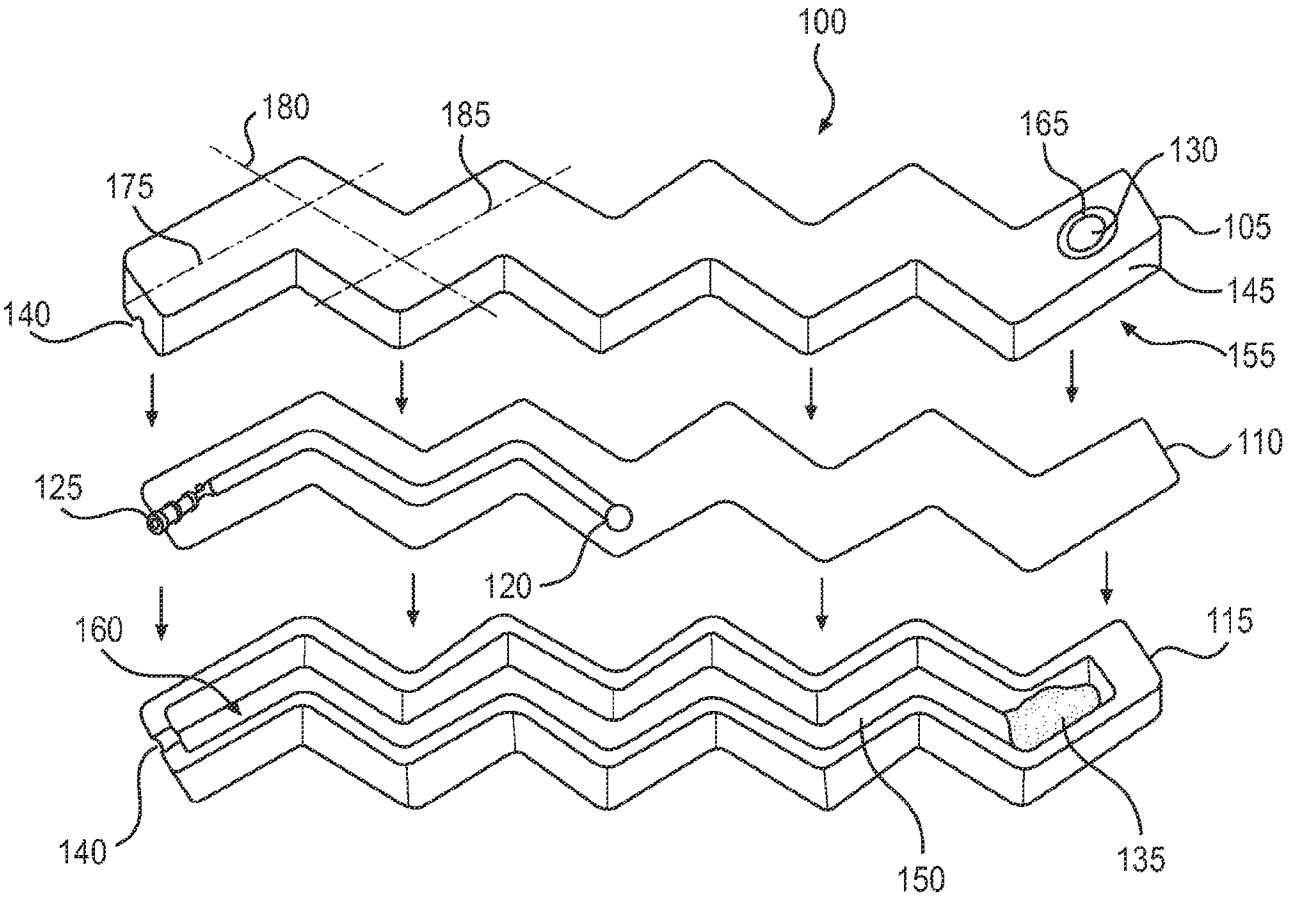
FIG. 1 illustrates an exemplary exploded view of the percussion instrument in accordance with aspects of embodiments of the invention.

Reference numbers refer to the same or equivalent parts of the present invention throughout the various figures of the drawings.

DETAILED DESCRIPTION OF EMBODIMENTS OF THE INVENTION

In the following description, the various embodiments of the present invention will be described with respect to the enclosed drawings.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice. As should be understood, at least some of the exemplary schematic representations are not necessarily drawn to scale in order to more clearly illustrate aspects of the present invention.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiments were chosen and described in order to best explain the principles of the present invention and its practical application, to thereby enable others skilled in the art to best utilize the present invention and various embodiments with various modifications as are suited to the particular use contemplated As used herein, the singular forms "a," "an," and "the" include the plural reference unless the context clearly dictates otherwise. For example, reference to "a particulate material" would also mean that mixtures of one or more particulate materials can be present unless specifically excluded.

Except where otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not to be considered as an attempt to limit the application of the doctrine of equivalents to the scope of the claims, each numerical parameter should be construed in light of the number of significant digits and ordinary rounding conventions.

The various embodiments disclosed herein can be used separately and in various combinations unless specifically stated to the contrary.

FIG. 1 illustrates an exemplary exploded view of the percussion instrument 100 in accordance with aspects of embodiments of the invention. The percussion instrument 100 is a multi-percussive hand drum designed to create varied and rhythmic sounds, for example, for musical accompaniment and/or solo performance. The innovative design makes the percussion instrument 100 beneficial to any percussion artist or drummer in the music industry, and/or for amateurs looking to experience a new dimension of percussive expression.

As shown in FIG. 1, the percussion instrument 100 includes an acoustic chamber housing 105 and a material (or sand) chamber housing 115. As shown in FIG. 1, each of the acoustic chamber housing 105 and a sand chamber housing 115 are structured in a zigzag shape (e.g., comprising, for example, a longitudinal axis line respective adjacent sections (e.g., section longitudinal axis lines 175, 180, 185) of the instrument going at an angle first in a first direction, then sharply (e.g., 90 degrees) the opposite direction, then back to the first direction, and so on, like the outline of a saw's teeth or a triangular wave). The percussion instrument of claim 1, wherein the zigzag shape comprises a longitudinal axis line of respective adjacent sections of the percussion instrument extending at an angle in a first direction, then sharply orthogonal to the first direction, and then back to the first direction.

In particular embodiments, each of the acoustic chamber housing 105 and the sand chamber housing 115 may comprise a solid piece of material (e.g., wood, plastic, metal, composite) that has been hollowed out or formed to create a respective chamber volume with an opening (155, 160) on one side. In some embodiments, the acoustic chamber housing 105 may include a sound hole 130 (e.g., arranged on a wall of the acoustic chamber housing 105 opposite the opening 155, for example, on an opposite side and/or an opposite end). In accordance with aspects of the invention, the sound hole 130 allows some of the generated sound to exit from the percussion instrument 100 through the sound hole 130 in a similar manner to a sound hole on an acoustic guitar. A microphone (e.g., a condenser or dynamic microphone) may be placed proximate the sound hole 130 to capture the generated sounds of the percussion instrument. Additionally, in accordance with further aspects of the invention, the sound hole 130 also provides an ingress location for sounds (for example, vocal sounds of a user) that can be picked up by an internal pickup device and combined with the sounds generated within the percussion instrument 100. For example, a user could sing, speak, and/or whistle into the sound hole 130 to create special sonic effects, while playing a percussive rhythm on the percussion instrument 100. As shown with the exemplary embodiment of FIG. 1, the sound hole 130 may include a reinforcement ring 165 arranged in the sound hole 130. In accordance with aspects of the invention, the reinforcement ring 165 may be functional, by providing a smooth surface around the sound hole 130, for example, to prevent splinters. Additionally, the reinforcement ring 165 may provide additional aesthetic features for the percussion instrument 100. While the exemplary embodiment of FIG. 1 includes a single sound hole 130, the invention contemplates embodiments having more than one sound hole and embodiments having no sound holes.

As shown in FIG. 1, the percussion instrument 100 also includes a sound board 110 arranged between the acoustic chamber housing 105 and the material (or sand) chamber housing 115, which together with the acoustic chamber housing 105 and the sand chamber housing 115, respectively, define an acoustic (or resonation) chamber 145 and a material (or sand) chamber 150. The sound board 110 is structured and arranged having the same zigzag shape so as to completely cover both the acoustic chamber housing 105 and a sand chamber housing 115, and to isolate the acoustic chamber 145 from the sand chamber 150. Additionally, as shown in FIG. 1, in embodiments, the sound board 110 is arranged generally planar to the longitudinal axis of the percussion instrument 100.

As shown in FIG. 1, the soundboard 110 has arranged (e.g., fastened and/or bonded) thereon, a pickup device 120, for example, a piezo transducer, that connects with a jack 125 (e.g., a ¼" jack) via suitable wiring. As additionally shown in the exemplary embodiment of FIG. 1, the acoustic chamber housing 105 and the sand chamber housing 115 may each include a notch 140 structured and arranged to accommodate the ¼" jack 125.

The pickup device 120 is arranged on a side of the soundboard 110 facing the acoustic chamber housing 105 so as to be located within the acoustic chamber 145. In accordance with aspects of the invention, the pickup device 120 allows the percussion instrument 100 to be connected to an amplifier or a public announcement (PA) system, to amplify the sounds (e.g., tapping rhythms) generated within the percussion instrument 100, and/or connected to effects devices (e.g., stomp boxes, multi-effects pedals, rack-mounted effects, etc.) to modify (e.g., delay, loop, distort, modulate, etc.) the sounds generated within the percussion instrument 100. While the exemplary embodiment of FIG. 1 illustrates a piezo transducer pickup device 120, the present invention contemplates other or additional pickup devices. For example, in contemplated embodiments, the pickup device 120 may comprise a microphone (e.g., a dynamic or condenser microphone) instead of (or in addition to) the piezo transducer.

In accordance with aspects of the invention, a piezo transducer is used to convert the vibrational or physical movement of the piezo transducer (and the movement of the sound board 110 upon which the piezo transducer is arranged) into an electrical signal. By arranging the piezo transducer in the percussion instrument 100, all of the external surfaces of the percussion instrument are "alive" or "ignited." In accordance with additional aspects of the invention, the piezo-equipped soundboard 110 can serve as a versatile resonator/pickup not only for the percussion instrument's own sounds, but also for other instruments. For example, the percussion instrument 100 may be played while the percussion instrument 100 is arranged on a drum (e.g., a snare drum or a cajon drum). As the percussion instrument 100 is impacted to generate a sound, the impact also actuates the snare drum or the cajon drum. In accordance with aspects of the invention, the piezo transducer captures both the sounds of the percussion instrument 100 and the sounds of the snare drum or the cajon drum, to create a composite sound that can be routed through, for example, one or more effects, a loop station, an amplifier, a rotary cabinet, and/or PA system.

With the exemplary embodiment of FIG. 1, the pickup device 120 is generally arranged towards the center of the sound board 110 with respect to a longitudinal axis of the percussion instrument 100. The invention contemplates, however, that the pickup device 120 may be arranged at positions on the sound board 110 other than in the region of the center. For example, in some contemplated embodiments, the pickup device 120 may be arranged closer to (or further from) the jack 125. Furthermore, while the exemplary embodiment of FIG. 1 illustrates a ¼" jack, the invention contemplates that other connection jacks may be utilized (e.g., a 3.5 mm jack or XLR jack, amongst other contemplated jacks).

The percussion instrument 100 also includes a material (e.g., sand) 135 (or other suitable particulate material, such as glass and/or plastic beads) arranged in the material (or sand) chamber 150. In accordance with aspects of the invention, the sand 135 allows the percussion instrument 100 to be used as a shaker, for example, by orienting the percussion instrument 100 in a generally horizontal direction, and shaking the percussion instrument 100 to move the sand 135 within the sand chamber, to create the shaker sound. In accordance with further aspects of embodiments of the invention, the sand also allows the percussion instrument 100 to be used as a rain stick, for example, by orienting the percussion instrument 100 in a generally vertical direction, such that, as the sand 135 falls from one end of the percussion instrument 100 to the other end, it impacts some of the inner wall surfaces of the sand chamber housing 115, to create the rain stick sound. In accordance with aspects of embodiments of the invention, the zigzag shape of the percussion instrument 100 provides multiple internal wall surfaces upon which sand may impact the sand chamber housing 115 as the sand 135 cascades through the sand chamber 150. In contrast to a conventional rain stick, which utilizes a plurality of pegs (or beams) traversing a cylindrical shaft to provide impact surfaces for the particulate material arranged in the cylindrical shaft and falling through the pegs, with the present invention, the arrangement of the zigzag wall surfaces provides impact surfaces without pegs traversing the sand chamber. In accordance with aspects of the present invention, this allows for a simpler manufacture and a more controllable flow of the particulate material (e.g., sand 135) through the percussion instrument 100. For example, with the present invention, the cascading of the sand 135 off the walls of the sand chamber housing 115 allow the speed of the rain stick sounds to be more precisely controlled with the tipping of the percussion instrument 100, as compared to a conventional rain stick. While the exemplary embodiment of FIG. 1 does not illustrate any pegs traversing the sand chamber 150, the invention contemplates that pegs may additionally be used with the present invention to enhance and/or modify the rain stick and shaker sounds of the present invention.

The sand chamber housing 115 may also include a hole (not shown) and an associated removable cap (not shown) structured and arranged to seal the hole. In embodiments, the cap may be located on an end of the percussion instrument 100 opposite to the sound hole 130 (e.g., on an opposite end and/or on an opposite side). In accordance with additional aspects of embodiments of the invention, the cap may be temporarily removable so that a user can, for example, change the sand 135 (or other suitable particulate material) in the sand chamber 150. By altering the type of sands 135 or other suitable particulate material contained in the sand chamber 150 (e.g., from fine sand to coarse sand), a user may alter the achievable sounds and sonic textures of the percussion instrument 100. In embodiments, the cap may be a pressure-fitting cap or may be a threaded cap. The present invention also contemplates embodiments without a hole, wherein the sand (or other suitable particulate matter) is not changeable without removing the sand chamber housing 115 from the sound board 110.

With additional contemplated embodiments, the percussion instrument 100 may contemporaneously utilize more than one type of sand (or other suitable particulate material). For example, a user may arrange two different types of particulate material in the sand chamber, to generate a composite sound, which may include the interactions (e.g., impacts) of each of the particulate material types with the walls of the sand chamber 150, and interactions (e.g., impacts) of the particulate material types with each other. With other contemplated embodiments, the percussion instrument may include a plurality of sand chambers, for example, arranged above one another with respect to a longitudinal axis of the percussion instrument 100, wherein each of the sand chambers includes a respective type of particulate material. That is, the sand chamber 150 illustrated in FIG. 1 may include a partition (not shown) arranged parallel to the sound board 115 to divide the sand chamber 150 into two sand chambers. In further contemplated embodiments, the plurality of sand chambers may be arranged, for example, one behind the other with respect to a longitudinal axis of the percussion instrument 100. That is, the sand chamber 150 illustrated in FIG. 1 may include a partition (not shown) arranged perpendicular to the sound board 115 to divide the sand chamber 150 into two sand chambers. With such an embodiment, the sand passage is shortened such that an effective length of the rain stick effect may be shortened.

In accordance with additional aspects of the invention, the generated sound of the percussion instrument 100, e.g., due to tapping, can be modified based on the location of the sand 135 in the sand chamber 150 and/or where the percussion instrument is impacted (or struck). For example, if the sand is moved to one end of the sand chamber, upon impacting (e.g., tapping) the percussion instrument 100 in the middle, the percussion instrument 100 will emit a tighter sound (e.g., similar to a kick drum). In contrast, with the sand 135 located at one end of the sand chamber 150, impacting the other end of the percussion instrument 100 will produce a clear sound. If the sand is spread throughout the sand chamber 150, the percussion instrument 100 will emit a bigger sound (e.g., similar to a snare drum) upon impacting the percussion instrument 100.

Figure 5:
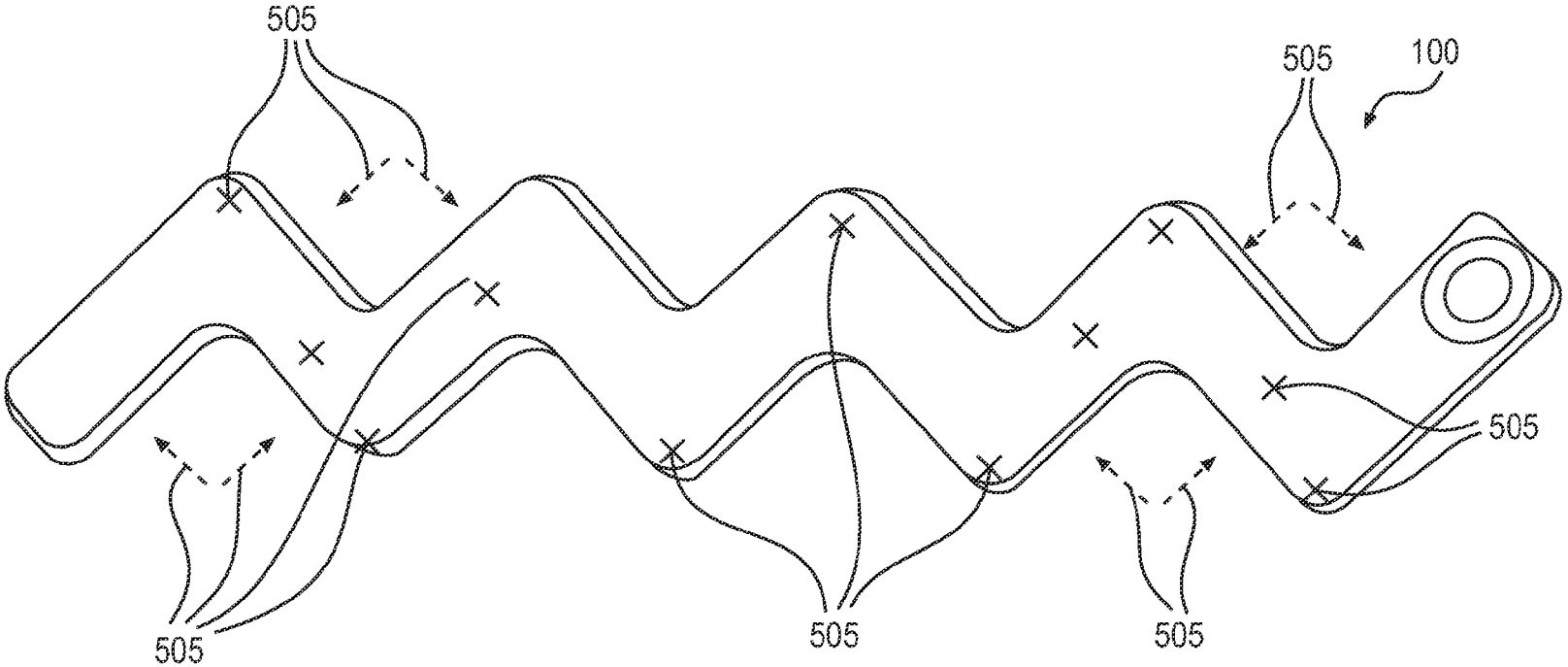
FIG. 5 shows an exemplary and non-limiting depiction of impact regions of the percussion instrument for producing Tom tones and/or bongo tones.
Figure 6:
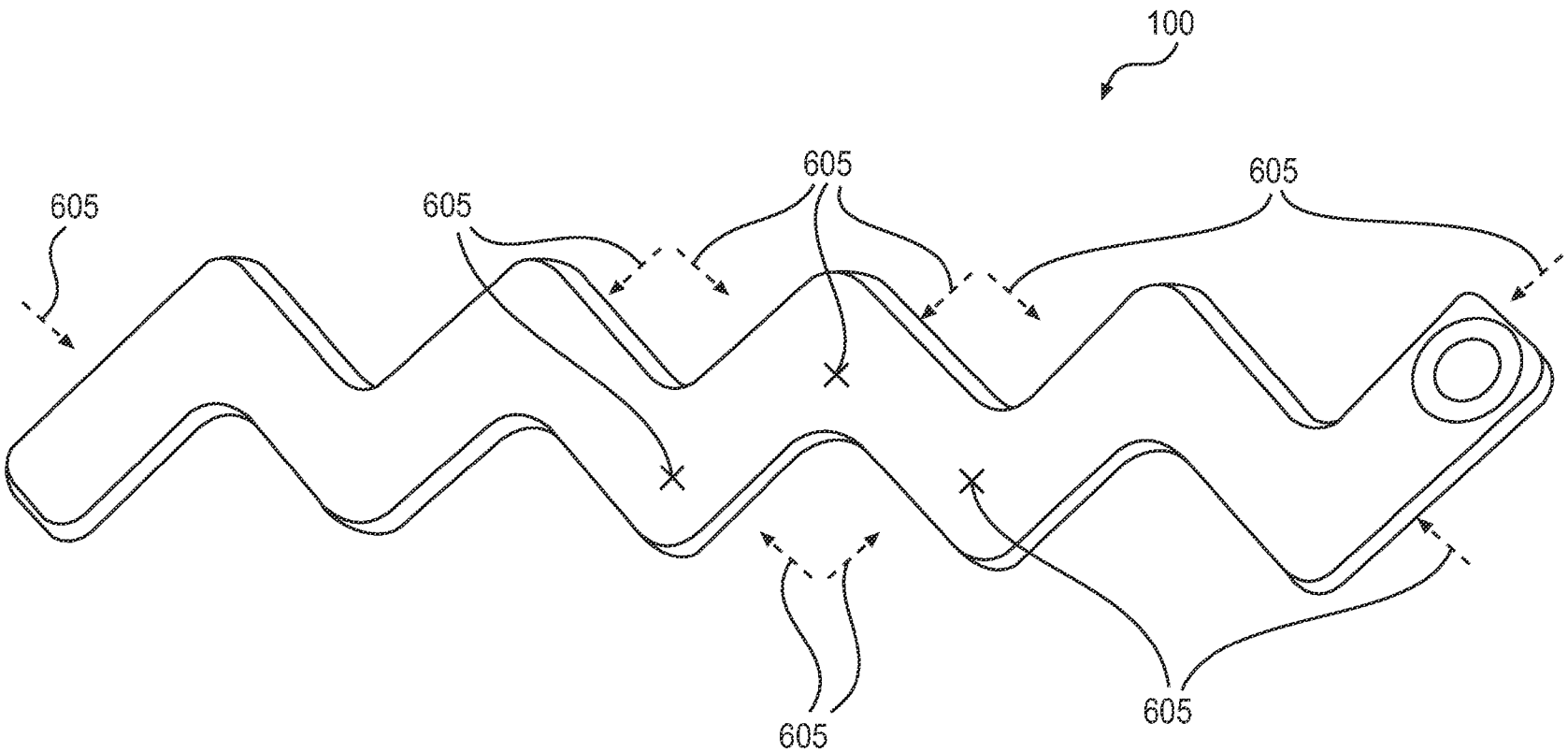
FIG. 6 shows an exemplary and non-limiting depiction of impact regions of the percussion instrument for producing bass tones.

In accordance with additional aspects of the invention, the zigzag shape of the percussion instrument 100 provides multiple surfaces that produce varying tones. For example, some surfaces of the percussion instrument 100 produce (e.g., upon tapping, impacting, etc.) lower frequency tones, while other surfaces (e.g., adjacent surfaces) may produce higher frequency tones. In other words, in accordance with aspects, of the invention, the percussion instrument 100 has a tone changing (or variable) quality, wherein every surface (e.g., each step of the zigzag) can produce a different tone. For example, as shown in FIGS. 5 and 6 (discussed further below), there are certain places on the percussion instrument 100 that will produce bass frequency tones, such as, for example, the end of the percussion instrument 100 (farthest away from the jack). Hitting this area of the percussion instrument with the palm of a hand will produce a deep bass frequency tone. Also, hitting the center area of the percussion instrument 100 with the palm or heal produces a deep bass frequency tone. The pitch gets higher as the impact area is moved away from the center of the percussion instrument 100. Higher frequency tones may be achieved by hitting with a finger (e.g., a tapping or slapping with a finger). The tone can even be altered by using one finger versus using two fingers. Additionally, the ranges of the tone frequencies (e.g., the higher tone frequencies) can be altered based on how the percussion instrument is impacted, where the percussion, instrument 100 is impacted, and what the percussion instrument 100 is impacted with (such as, for example, a finger, drum mallets or brushes).

Also, due to the zigzag shape, the type and location of impact (e.g., finger, palm, hand) may affect the produced tone. For example, every surface may have a different tone depending upon how the surface is impacted (e.g., hitting with the heal of a hand versus hitting with one finger). Impacting the steps (or zigzags) with the heal of a hand produces varying bass frequency tones, whereas hitting some of the same places with a finger produces higher frequency tones. In accordance with further aspects of the invention, the location of the impact site relative to the pickup 120 affects the produced tone of the percussion instrument 100.

In contemplated embodiments, the acoustic chamber housing 105, the sand chamber housing 115 and the sound board 110 may be crafted out of woods (e.g., burl and high figured woods), plastics, metals and/or other composite materials. With regard to wood materials, generally, in embodiments, the acoustic chamber housing 105 and the sand chamber housing 115 may include any sufficiently dense (or harder) wood in order to capture the vibrations of (or within) the percussion instrument 100. For example, with non-limiting embodiments, the wood for the acoustic chamber housing 105 and the sand chamber housing 115 may include one or more of walnut, redwood, maple, and purple heart, amongst other contemplated woods. In embodiments, the wood for the sound board 110 may be a softer (e.g., less dense) wood in order to resonate in the percussion instrument 100. For example, with non-limiting embodiments, the wood for sound board 110 may include spruce and cedar, amongst other contemplated woods. In contemplated embodiments, the sound board 110 may comprise multiple wood layers (e.g., a laminate of different woods) to manipulate the tonal quality of the percussion instrument 100 and/or to compensate for natural materials of the sound board 110.

While the above exemplary embodiment has been described with regard to wood materials, the present invention contemplates embodiments comprising different materials. For example, in embodiments of the present invention, the sound board, the acoustic chamber housing and/or the sand chamber housing may be constructed using plastic materials. With one contemplated exemplary embodiment, the acoustic chamber housing and the sand chamber housing comprise plastic materials (e.g., molded plastic), and the sound board comprises a wood material. With another contemplated exemplary embodiment, the acoustic chamber housing, the sand chamber housing, and the sound board comprise plastic materials (e.g., molded plastic).

In further embodiments of the present invention, the sound board, the acoustic chamber housing and/or the sand chamber housing may be constructed using metal materials. In yet further embodiments of the present invention, the sound board, the acoustic chamber housing and/or the sand chamber housing may be constructed using composite materials.

In yet further embodiments of the present invention, the acoustic chamber housing 105 and/or the sand chamber housing 115, instead of comprising one piece of material, may comprise two pieces of the same or different material (e.g., one piece defining the side walls and the other piece defining the top or bottom wall). As such, with contemplated embodiments, the percussion instrument 100 may comprise a three-piece laminate, a four-piece laminate, or a five-piece laminate.

Figure 2:
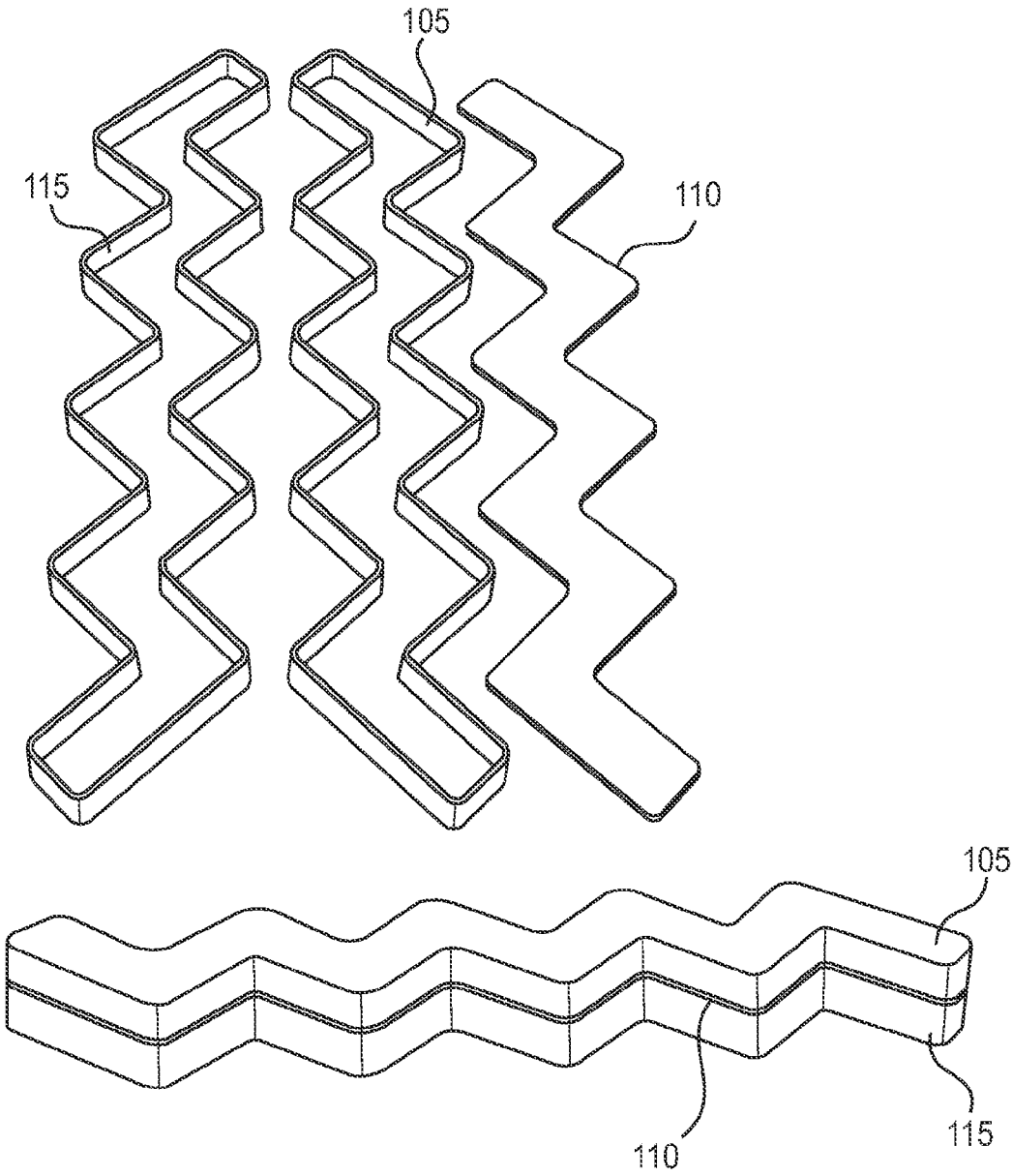
FIG. 2 shows exemplary views of the sand chamber housing, the acoustic chamber housing and the sound board, and a view of the percussion instrument in accordance with aspects of the invention.

FIG. 2 shows exemplary views of the sand chamber housing 115, the acoustic chamber housing 105 and the sound board 110, and a view of an assembled percussion instrument 100 in accordance with aspects of the invention. With an exemplary embodiment, the sand chamber housing 115 (and the acoustic chamber housing 105) may be formed, for example, using a computer numerical control (CNC) machine to hollow out a chamber space from respective solid pieces of wood. With an exemplary and non-limiting embodiment, a piece of wood having a 1" thickness may be hollowed out to form walls (e.g., side and bottom walls) having a ⅛" thickness. As shown in FIG. 2, the sand chamber housing 115 and the acoustic chamber housing 105 are bonded together (e.g., laminated together with an adhesive or glue) with the sound board 110 there between (or each of the sand chamber housing 115 and the acoustic chamber housing 105 are bonded to the sound board 110) to form an embodiment of the percussion instrument 100.

Figure 3:
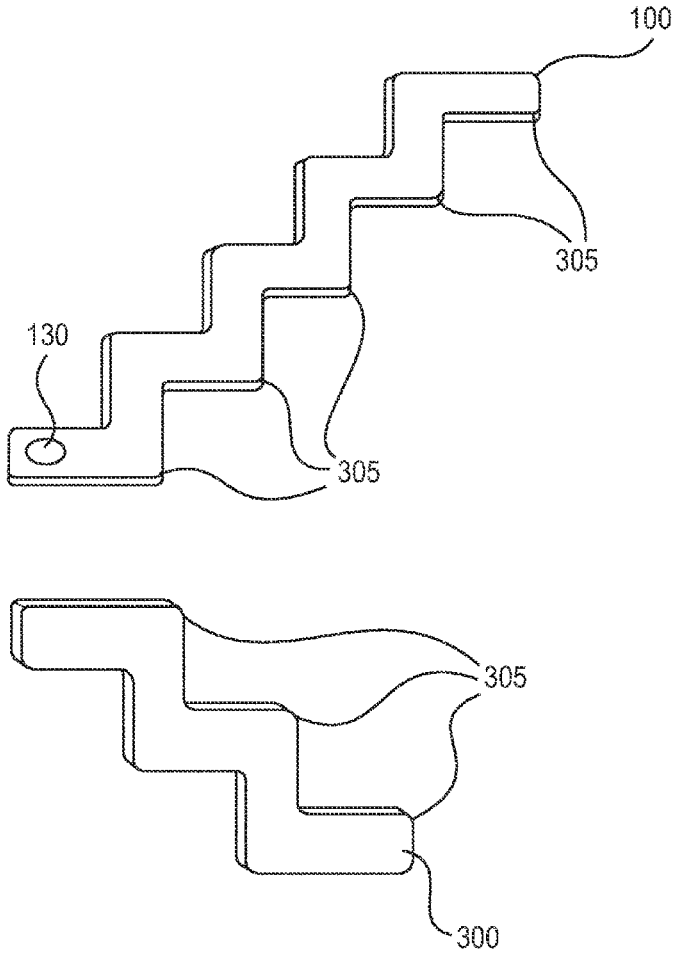
FIG. 3 shows exemplary top views of contemplated embodiments of the present invention.

FIG. 3 shows top views of various contemplated embodiments of the present invention. More specifically, FIG. 3 shows exemplary views of a 5-point percussion instrument 100 (e.g., a 5-point version) and a 3-point percussion instrument 300 (e.g., a 3-point version) in accordance with aspects of the invention. As shown in FIG. 3, the 5-point percussion instrument 100 includes five points 305 on the zigzag apex corners of the instrument. Alternatively, a percussion instrument 300 may be structured to include three points 310 (e.g., the 3-point version). As shown in FIG. 3, the 3-point percussion instrument 300 includes three points 305 on the zigzag apex corners of the instrument. Additionally, as shown in FIG. 3, the invention contemplates embodiments having one or more sound holes 130 (e.g., percussion instrument 100) and embodiments without a sound hole (e.g., percussion instrument 300). As should be understood, the present invention may come in a variety of sizes and exact specifications may vary to suit manufacturing needs. Moreover, while the above exemplary embodiments include the 5-point version and the 3-point version, the present invention contemplates embodiments having more or less zigzags, and consequently, more or less points (or apexes).

Figure 4:
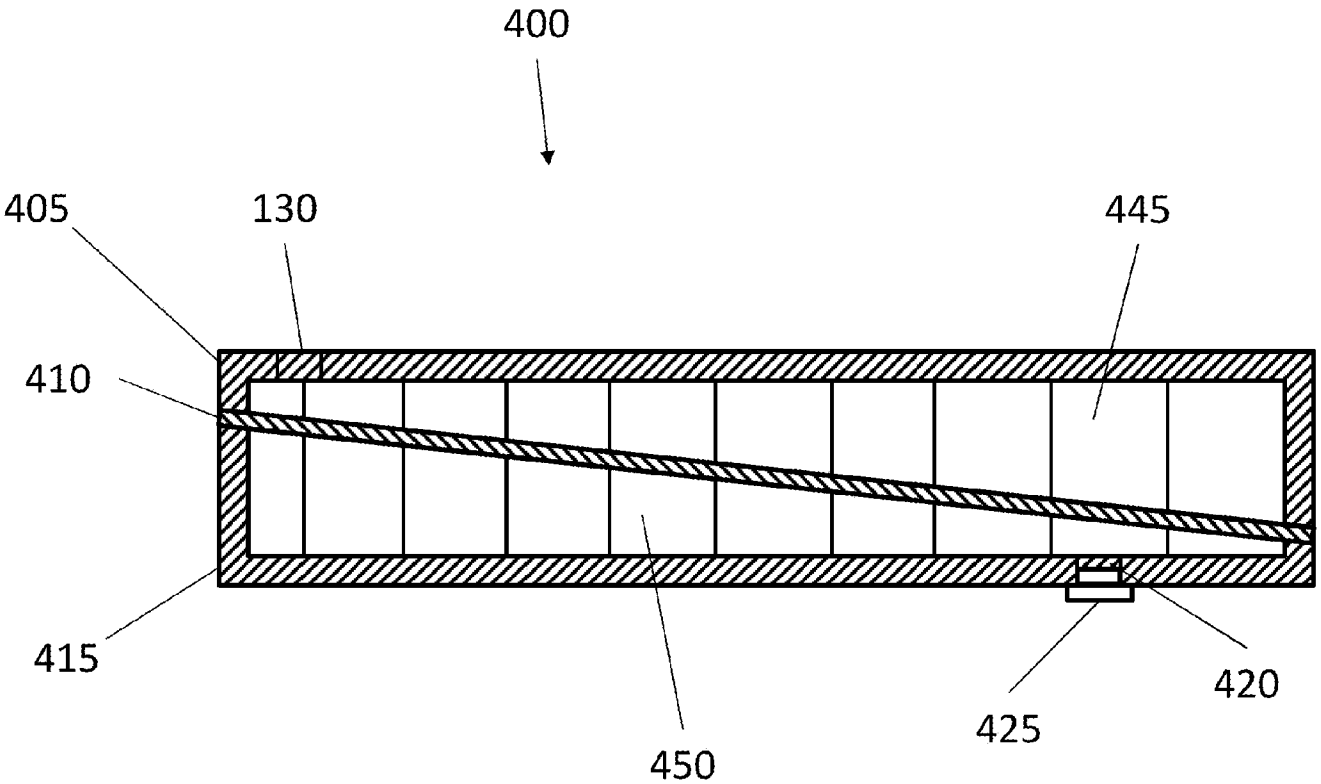
FIG. 4 shows exemplary schematic representation of a "tapered" percussion instrument in accordance with aspects of the invention.

FIG. 4 shows exemplary sectional schematic representation of a "tapered" percussion instrument 400 in accordance with aspects of the invention. As shown in FIG. 4, with the "tapered" percussion instrument 400, the sound board 410 is arranged to slant from one end to the other end of the percussion instrument 400 such that both the sand (or material) chamber 450 and the acoustic chamber 445 are tapered. For example, as shown in FIG. 4, from left to right (e.g., in a direction away from the sound hole 130), the height of the acoustic chamber 445 progressively increases and the height of the sand chamber 450 progressively decreases. The invention also contemplates the opposite orientation (not shown), wherein in a direction away from the sound hole, the height of the acoustic chamber progressively decreases and the height of the sand chamber progressively increases. As additionally shown in the exemplary schematic representation of FIG. 4, embodiments of the "tapered" percussion instrument 400 may include a tapered acoustic chamber housing 405 and a complimentary tapered sand chamber housing 415. In accordance with aspects of the invention, the tapered acoustic chamber housing 405 and the complimentary tapered sand (or material) chamber housing 415 are structured and arranged so that the sound board 410 arranged there between adopts a slanted orientation. In accordance with aspects of this embodiment of the present invention, the tapered design alters the emitted tone of the percussion instrument 400 along the longitudinal axis of the instrument, e.g., to emit different tones as a user strikes the instrument at different points along the longitudinal axis of the instrument. As additionally shown in FIG. 4, the sand chamber housing 415 includes a hole 420 and associated removable cap 425 to facilitate changing of the particulate material (not shown) in the sand chamber 450.

FIG. 5 shows an exemplary and non-limiting depiction of impact regions 505 of the percussion instrument 100 for producing Tom tones (i.e., tones similar to those of a Tom-Tom drum) and/or bongo tones (i.e., tones similar to those of a bongo drum).

FIG. 6 shows an exemplary and non-limiting depiction of impact regions 605 of the percussion instrument 100 for producing bass tones (i.e., tones similar to those of a bass or kick drum).

What has been described above includes examples of the disclosed architecture. It is, of course, not possible to describe every conceivable combination of components and/or methodologies, but one of ordinary skill in the art may recognize that many further combinations and permutations are possible. For example, the invention contemplates an embodiments having a single chamber, for example, an acoustic chamber (e.g., formed by the acoustic chamber housing and a sound board), or a material chamber (e.g., formed by the material chamber housing and the sound board).

Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the invention has been described with reference to specific embodiments, those skilled in the art will understand that various changes may be made and equivalents may be substituted for elements thereof without departing from the true spirit and scope of the invention. In addition, modifications may be made without departing from the essential teachings of the invention.

What is claimed is:

1. A percussion instrument, comprising:

an acoustic chamber housing having a zigzag shape;

a material chamber housing having the zigzag shape;

a sound board having the zigzag shape arranged between the acoustic chamber housing and the material chamber housing to form an acoustic chamber defined by the acoustic chamber housing and the sound board, and a material chamber defined by the material chamber housing and the sound board; and particulate material arranged in the material chamber.

2. The percussion instrument of claim 1, further comprising a pickup device arranged on the sound board.

3. The percussion instrument of claim 2, wherein the pickup device comprises a piezo transducer.

4. The percussion instrument of claim 2, further comprising an instrument jack connected to the pickup device and arranged at an exterior surface of the percussion instrument.

5. The percussion instrument of claim 1, wherein the particulate material comprises one or more types of sand.

6. The percussion instrument of claim 1, wherein the sound board is structured and arranged substantially parallel to a longitudinal axis of the percussion instrument.

7. The percussion instrument of claim 1, wherein the acoustic chamber housing comprises at least one sound hole.

8. The percussion instrument of claim 1, wherein the sound board is structured and arranged to resonate.

9. The percussion instrument of claim 1, wherein the acoustic chamber housing, the material chamber housing, and the sound board are laminated together to form the acoustic chamber and the material chamber.

10. The percussion instrument of claim 1, further comprising a removable cap, wherein the material chamber housing comprises a hole structured and arranged for removing and/or placing the particulate material into the material chamber, and wherein the at least the plug is structured and arranged to seal the hole.

11. The percussion instrument of claim 1, wherein the sound board is structured and arranged substantially non-parallel or slanted with respect to a longitudinal axis of the percussion instrument so as to form a tapered acoustic chamber and a tapered material chamber.

12. The percussion instrument of claim 1, wherein the zigzag shape comprises a longitudinal axis line of respective adjacent sections of the percussion instrument extending at an angle in a first direction, then sharply orthogonal to the first direction, and then back to the first direction.

13. The percussion instrument of claim 1, wherein the acoustic chamber housing, the material chamber housing, and the sound board comprise one or more types of wood.

14. The percussion instrument of claim 1, wherein at least one of the acoustic chamber housing, the material chamber housing, and the sound board comprise one or more types of plastic.

15. The percussion instrument of claim 1, wherein the acoustic chamber is isolated from the material chamber by the sound board arranged there between.

16. A percussion instrument, comprising:

an acoustic chamber housing having a zigzag shape;

a material chamber housing having the zigzag shape;

a sound board having the zigzag shape arranged between the acoustic chamber housing and the material chamber housing to form an acoustic chamber defined by the acoustic chamber housing and the sound board, and a material chamber defined by the material chamber housing and the sound board;

particulate material arranged in the material chamber;

a piezo transducer pickup device arranged on the sound board;

an instrument jack connected to the pickup device and arranged at an exterior surface of the percussion instrument, wherein the acoustic chamber housing, the material chamber housing, and the sound board are laminated together to form the acoustic chamber and the material chamber, and wherein the acoustic chamber is isolated from the material chamber by the sound board arranged there between.

17. A method of making a percussion instrument comprising an acoustic chamber housing having a zigzag shape; a material chamber housing having the zigzag shape; a sound board having the zigzag shape arranged between the acoustic chamber housing and the material chamber housing, the method comprising:

bonding the acoustic chamber housing, the sound board, and the material chamber housing together to form an acoustic chamber defined by the acoustic chamber housing and the sound board, and a material chamber defined by the material chamber housing and the sound board, and providing particulate material in the material chamber.

18. The method of claim 17, further comprising forming each of the acoustic chamber housing, the sound board, and the material chamber housing to have respective corresponding zigzag shapes.

19. The method of claim 17, further comprising:

forming an acoustic chamber space in the acoustic chamber housing by removing material from the acoustic chamber housing, and forming a material chamber space in the material chamber housing by removing material from the material chamber housing.

20. The method of claim 17, further comprising:

molding the acoustic chamber housing to form an acoustic chamber space, and molding the material chamber housing to form a material chamber space.

* * * * *